US005609244A

United States Patent [19]

Reiter

[11] Patent Number: 5,609,244

[45] Date of Patent: Mar. 11, 1997

[54] INTERLOCK DEVICE

[75] Inventor: John P. Reiter, Apple Valley, Minn.

[73] Assignee: Reitech Corporation, Burnsville, Minn.

[21] Appl. No.: 557,963

[22] Filed: Nov. 13, 1995

[51] Int. Cl.[6] ..... H01H 9/28

[52] U.S. Cl. ..... 200/43.11; 200/43.16

[58] Field of Search ..... 200/43.01, 43.11, 200/43.16, 43.22

[56] References Cited

U.S. PATENT DOCUMENTS

| | | | |
|---|---|---|---|
| 1,376,813 | 5/1921 | Horton | 200/43.16 |
| 1,443,867 | 1/1923 | Burns . | |
| 1,981,353 | 11/1934 | Getchell | 200/43.16 |
| 1,986,221 | 1/1935 | Sachs | 200/43.16 |
| 5,288,958 | 2/1994 | Grunert | 200/43.11 |
| 5,463,196 | 10/1995 | Darimont | 200/43.16 |

*Primary Examiner*—David J. Walczak

*Attorney, Agent, or Firm*—Peterson, Wicks, Nemer & Kamrath

[57] ABSTRACT

An interlock device (76) is disclosed in connection with an electric circuit actuating mechanism (10). A latch (88) is rotatably fixed to the shaft (86) extending between a knob (80) and a master switch (78). The latch (88) includes an arcuate arm (94) which slides through an aperture (126) of a catch (120) when the closure (26) is in a closed position relative to a switch box (11). The catch (120) includes a cam (128) which holds a latch plate (104) in an unlatched position when the closure (26) is in its closed position, with the latch plate (104) in the unlatched position being in a non-interfering relation with the rotation of the latch (88), switch (78), and knob (80). When the closure (26) is in an open position, the cam (128) does not engage the latch plate (104) which moves under bias to a latch position. In its latch position, a notch (110) in the latch plate (104) receives an extension (96) formed on the latch (88) to prevent rotation of the latch (88), switch (78), and knob (80) from their off position.

23 Claims, 2 Drawing Sheets

INTERLOCK DEVICE

BACKGROUND

The present invention generally relates to interlock devices, particularly to interlock devices allowing opening of enclosures only under certain circumstances, and specifically to interlock devices for electrical control boxes allowing opening of the box only when power has been switched off.

In various applications, it is desirable that enclosures can only be opened under certain circumstances. As an example, electrical control boxes should be opened only after power to the electrical controls located in the interior of the box has been interrupted to reduce the risk of electrical shock by contact with the electrical controls. Therefore, interlocks have been developed which require a master switch to be in an off position before the door to the control box can be opened. Conventionally, such interlocks were accomplished by having the shaft which operates the master switch extending through an opening in the face of the door of the control box. The shaft included an abutment which in the switch-off position was aligned with a slot allowing the door to be opened but when not in the switch-off position was not aligned with and was unable to pass through the slot preventing the door from being opened. An example of such an arrangement where abutment occurred inside of the box is shown in U.S. Pat. No. 1,443,867. However, there are circumstances where an interlock is desired but for whatever reason, the shaft which operates the master switch can not be located through the face of the door of the box. Such a circumstance exists utilizing the mechanism shown in U.S. Pat. No. 5,510,587 where the entire front face is desired to be pushed to de-energize the electric circuit.

Thus, a need has arisen for an interlock device which prevents opening an enclosure except under certain circumstances and which is operable from other than the face of the door or closure of the enclosure.

SUMMARY

The present invention solves this need and other problems in the field of interlock devices by providing, in the preferred form, a latch rotatable between an on and an off position, and a catch for the latch in the on position and when the closure of the enclosure is closed. The latch is selectively prevented from rotating from the off position to the on position by a member in a latched position, with the member allowing rotation of the latch in an unlatched position. The member is moved and held in the unlatched position when the closure of the enclosure is closed.

It is thus an object of the present invention to provide a novel interlock device.

It is further an object of the present invention to provide such a novel interlock device allowing opening of an enclosure only under certain circumstances.

It is further an object of the present invention to provide such a novel interlock device for electrical control boxes.

It is further an object of the present invention to provide such a novel interlock device not requiring a shaft extending through the face of the closure.

It is further an object of the present invention to provide such a novel interlock device of a simple design easy to manufacture and assemble.

These and further objects and advantages of the present invention will become clearer in light of the following detailed description of an illustrative embodiment of this invention described in connection with the drawings.

DESCRIPTION OF THE DRAWINGS

The illustrative embodiment may best be described by reference to the accompanying drawings where.

Figure 1:
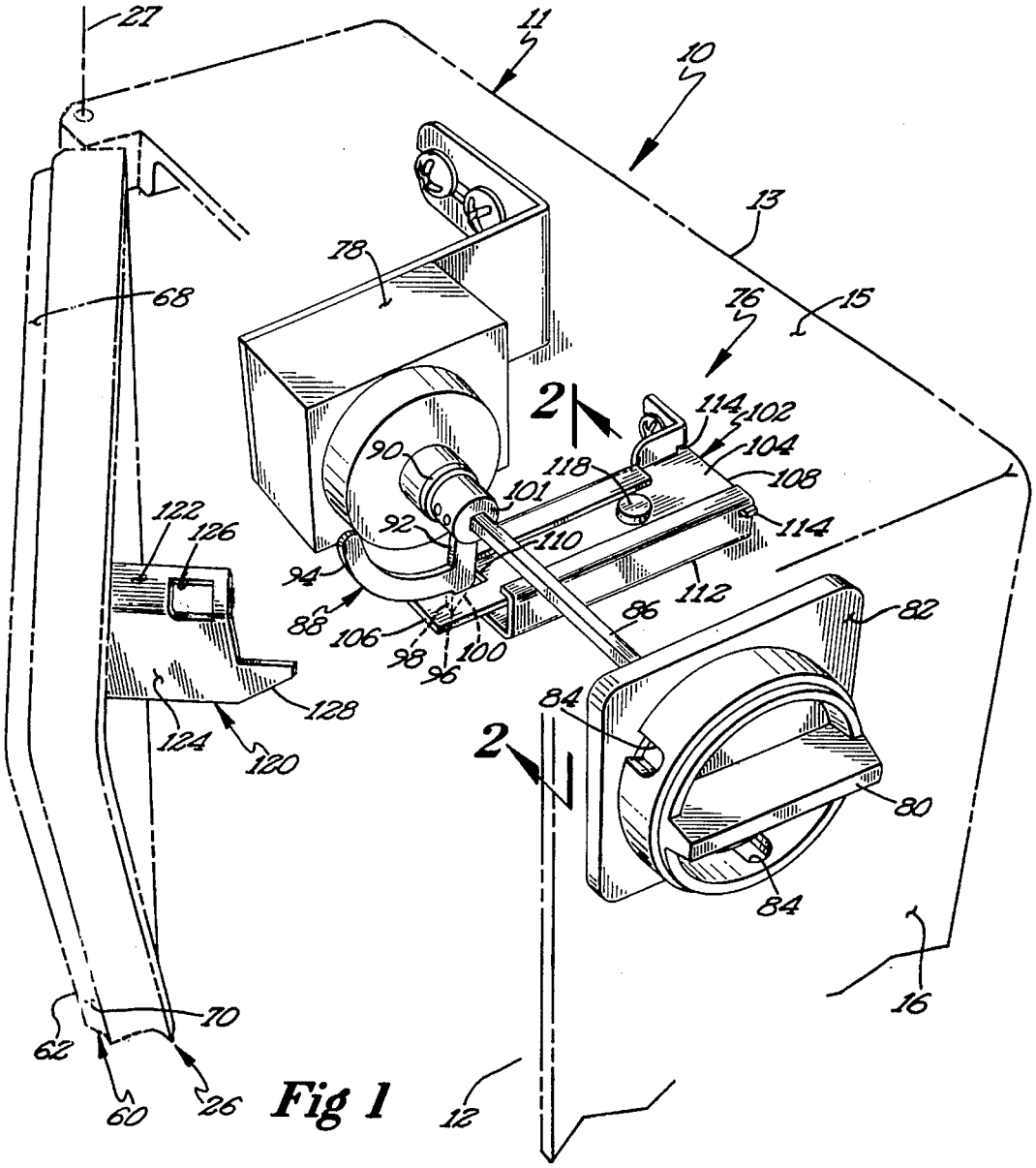
FIG. 1 shows a partial, perspective view of an electric circuit actuating mechanism including an interlock device according to the preferred teachings of the present invention, with the closure of the mechanism being in its open position, with portions shown in phantom.

All figures are drawn for ease of explanation of the basic teachings of the present invention only; the extensions of the Figures with respect to number, position, relationship, and dimensions of the parts to form the preferred embodiment will be explained or will be within the skill of the art after the following description has been read and understood. Further, the exact dimensions and dimensional proportions to conform to specific force, weight, strength, and similar requirements will likewise be within the skill of the art after the following description has been read and understood.

Where used in the various figures of the drawings, the same numerals designate the same or similar parts. Furthermore, when the terms "top", "bottom", "first", "second", "inside", "outside", "front", "back", "outer", "inner", "upper", "lower", "height", "width", "length", "end", "side", "horizontal", "vertical", "rear", and similar terms are used herein, it should be understood that these terms have reference only to the structure shown in the drawings as it would appear to a person viewing the drawings and are utilized only to facilitate describing the illustrative embodiment.

DESCRIPTION

An interlock device between a closure and an enclosure according to the preferred teachings of the present invention is shown in the drawings and generally designated 76. In the preferred form, device 76 is utilized in connection with an electric circuit actuating mechanism 10 and in the most preferred form of the type shown and described in U.S. Pat. No. 5,510,587 For purpose of explanation of the basic teachings of the present invention, the same numerals designate the same or similar parts in the present figures and the figures of U.S. Pat. No. 5,510,586. The description of the common numerals and mechanism 10 may be found herein and in U.S. Pat. No. 5,510,587, which is hereby incorporated herein by reference.

Mechanism 10 generally includes a first generally rectangular box-like enclosure or switch box 11 having an open front 12, a rear wall 13, an upper or top wall 15 and integrally formed right and left side walls 16. One or more walls 13, 15, and 16 have one or more apertures (not shown) passing therethrough allowing electrical wiring to be routed from a source of power into switch box 11 and out of switch box 11 to the power tool or device being controlled. Alternately, mechanism 10 could be in an extension cord-type arrangement where switch box 11 could include a female outlet mounted thereto for electrical connection to the male plug of the power tool wished to be actuated and could also include a cord extending therefrom terminating in a male plug for electrical connection to a conventional wall outlet or the like.

Figure 2:
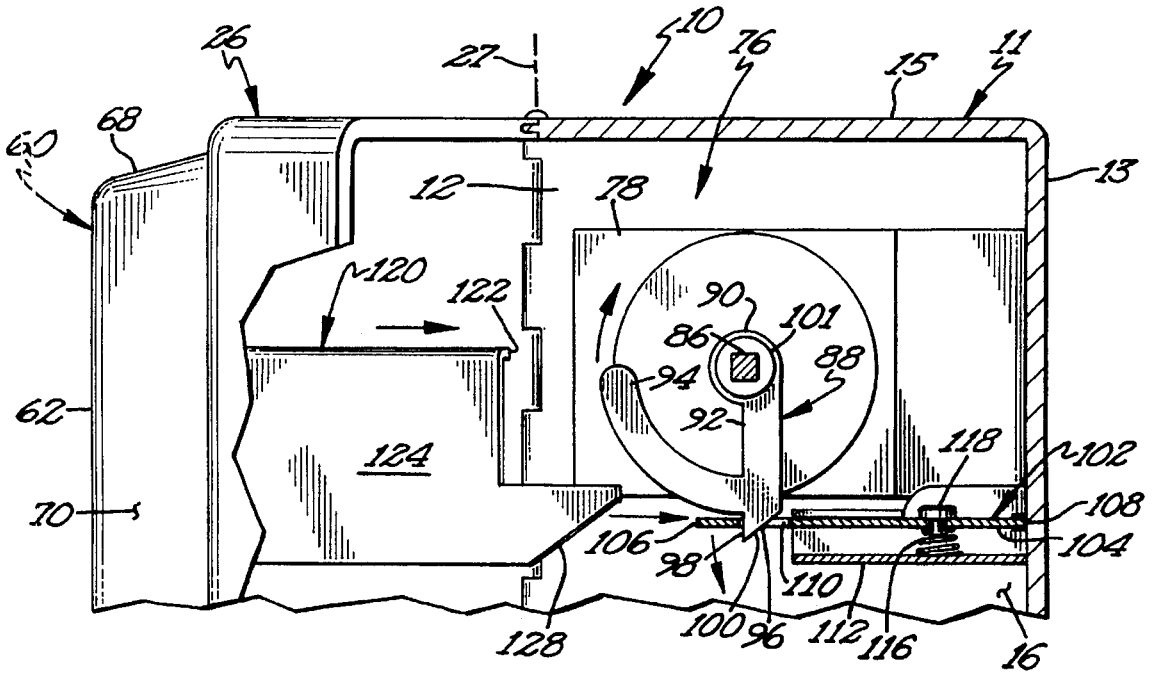
FIG. 2 shows a partial, sectional view of the mechanism of FIG. 1 according to section line 2—2 of FIG. 1.
Figure 3:
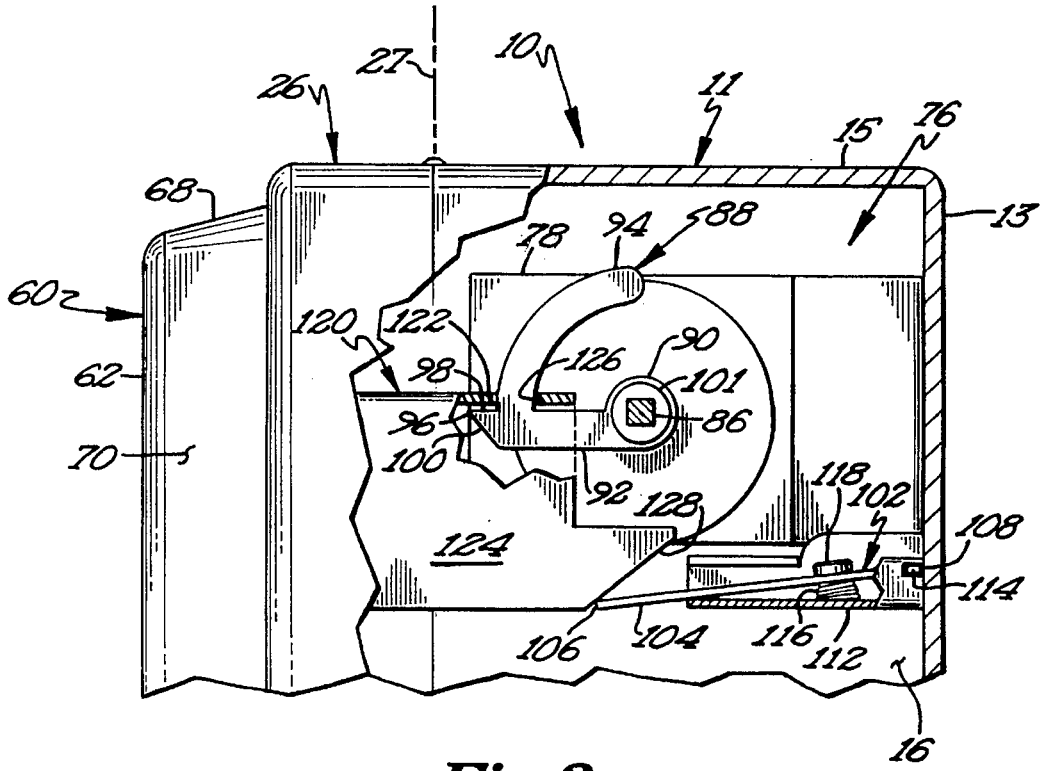
FIG. 3 shows a partial, sectional view of the mechanism of FIG. 1 similar to the sectional view of FIG. 2 but with the closure of the mechanism being in its closed position and the interlock device in its on position.

Switch box 11 further generally includes a closure 26 in the form of a housing which is hingedly mounted about an axis 27 extending parallel to and adjacent the left side wall 16. Housing 26 is movable and in the most preferred form pivotable between a closed position as best seen in FIG. 3 extending over and closing front 12 and an open position as best seen in FIGS. 1 and 2 allowing access through front 12 into the interior of switch box 11 and the electrical controls located therein. Housing 26 includes a relatively movable cover 60 of a rectangular, box-like structure having a broad surface front wall 62, an integrally formed upper or top wall 68, and integrally formed side walls 70. By pushing against wall 62, the electric circuit controlled by mechanism 10 is de-energized.

Interlock device 76 in the preferred form includes a master switch 78 which in its off position prevents the closure of an energizing momentary switch of mechanism 10 and generally interupts electrical current to the fuses and other electrical controls located within switch box 11. Master switch 78 in the most preferred form is a standard, off-the-shelf component and is suitably mounted inside switch box 11 such as to rear wall 13 as shown.

Device 76 further includes a control knob 80 rotatably mounted inside of a collar 82 between an on position and an off position. Knob 80 and collar 82 include at least one set of apertures 84 which are aligned when knob 80 is located in the off position for receiving the clasp of a lock such that knob 80 can be locked in its off position by suitable personnel to prevent undesired rotation of knob 80. Knob 80 and collar 82 in the most preferred form are standard, off the shelf components and are suitably mounted to the right side wall 16, with knob 80 and collar 82 generally located outside of switch box 11 and with portions of knob 80 accessible from inside of switch box 11. A shaft 86 having square cross sections in the most preferred form extends between and positionally interconnects knob 80 with switch 78, with rotation of knob 80 between its on and off position correspondingly moving switch 78 between its on and off positions.

Device 78 further includes a latch 88 maintaining the same rotational position as shaft 86 such that latch 88 is rotatable about an axis defined by shaft 86 between a first, on position and a second, off position. In the most preferred form, latch 88 includes an annular collar 90 having an internal opening of a size for slideably receiving shaft 86. Due to the square shape of shaft 86 and the internal opening of collar 90, collar 90 maintains the same rotational position relative to shaft 86. Latch 88 further includes an arm 92 integrally and radially extending from collar 90. An arcuate arm 94 integrally extends from arm 92 at a location spaced from collar 90, with arm 94 extending from arm 92 generally concentric to shaft 86 and in particular to the axis of rotation of shaft 86. A generally triangular-shaped extension 96 integrally extends generally coextensively with arm 92 beyond arm 94 and rotatable with arm 94. Extension 96 generally includes a generally radially extending abutment surface 98 generally coextensive with the radially extending surface of arm 92 from which arm 94 extends. Extension 96 further includes a cam surface 100 extending from the radially outermost portion of surface 98 to the radially extending surface of arm 92 opposite arm 94. Latch 88 in the most preferred form is held in the same axial position on shaft 86 by a locking collar 101 which sandwiches collar 90 against switch 78.

Device 76 further includes provisions 102 for selectively preventing rotation of switch 78 and knob 80 from their off position. In particular, provisions 102 include a generally planar, rectangular latch plate 104 having a free edge 106 and an opposite edge 108. A notch 110 of a right parallelogram shape extends from one of the side edges of latch plate 104 spaced from free edge 106. Notch 110 has a size for receiving extension 96 with abutment surface 98 abutting with the forward edge of notch 110 adjacent free edge 106. Latch plate 104 is mounted for movement between a latch position and an unlatch position, with plate 104 being biased from its unlatch position to its latch position. In the preferred form, provisions 102 generally include a generally tubular mount 112 suitably mounted to rear wall 13 such as shown. Mount 112 has cross sections of a generally rectangular shape and having a width generally equal to and for slideably receiving latch plate 104 therebetween and having a height substantially greater than and in the preferred form generally equal to a multiple of the thickness of latch plate 104. Mount 112 upstands from rear wall 13 a distance generally equal to the spacing of notch 110 from edge 108. In the preferred form, latch plate 104 is pivotally mounted inside mount 112 and in the most preferred form by ears 114 extending from the opposite sides of latch plate 104 adjacent to edge 108, with ears 114 received in cutouts formed in the sides of mount 112 adjacent rear wall 13. A spring 116 is provided sandwiched between latch plate 104 and the bottom of mount 112 opposite shaft 86 for biasing latch plate 104 to pivot about ears 114 towards the top of mount 112. A spring retainer 118 is mounted to latch plate 104 and extends toward the bottom of mount 112 for retaining spring 116 in position therearound. In the most preferred form, mount 112 includes a slot extending its full length and which provides clearance for retainer 118 extending above latch plate 104. Notch 110 should be positioned at the same axial position relative to shaft 86 as latch 88 and specifically extension 96 thereof.

With switch 78 and knob 80 in their off position and latch plate 104 in its latch position, extension 96 extends into notch 110 and a portion of latch plate 104 intermediate edge 106 and notch 110 abuts with arcuate arm 94. It can then be appreciated that any attempt to rotate knob 80 towards its on position results in abutment surface 98 abutting with the forward edge of notch 110 due to the mounting of latch 88 to shaft 86. Thus, rotation of switch 78 and knob 80 to its on position is prevented by device 76 according to the preferred teachings of the present invention. However, in the most preferred form, device 76 can be manually overridden if desired. Specifically, latch plate 104 can be pushed such as by a finger adjacent edge 106 to pivot latch plate 104 about the axis defined by ears 114 from its latch position to its unlatch position. In its unlatch position, latch plate 104 is in a non-interfering relation with latch 88 and specifically extension 96 thereof such that extension 96 does not extend into notch 110. Thus, in the unlatch position, rotation of switch 78 and knob 80 is possible from the off position to the on position. After switch 78 and knob 80 have been rotated from the off position sufficiently such that extension 96 does not extend into notch 110, latch plate 104 can be released to move from its unlatch position to its latch position under the bias of spring 116 such that it is not necessary to continually hold latch plate 104. In the event that switch 78 and knob 80 are rotated back to their off position, cam surface 100 of extension 96 engages free edge 106 and latch plate 104 to push latch plate 104 to its unlatch position against the bias of spring 116 until extension 96 is aligned with notch 110 at which time latch plate 104 can move to its latch position with extension 96 again extending into notch 110. Thus, switch 78 and knob 80 are again prevented from rotating from their off position.

Device 76 further includes a catch 120 suitably attached to housing 26 and for catching latch 88 in its first, on position and when housing 26 is in its closed position. In the most preferred form, catch 120 has generally L-shaped cross sections including a first plate 122 and a second plate 124. Plate 122 is generally planar and with housing 26 in its closed position extends along a tangent to shaft 86 and its axis of rotation. An aperture 126 is formed in plate 122 at radial spacing from shaft 86 when housing 26 is in its closed position generally corresponding to and for receipt of arcuate arm 94. The lower edge of plate 124 opposite to plate 122 includes a cam 128 for engaging latch plate 104 when housing 26 is in its closed position. In particular, just prior to housing 26 moving to its closed position, cam 128 should engage latch plate 104 in its latch position. With further movement of housing 26 towards its closed position, cam 128 should move latch plate 104 from its latch position to its unlatch position against the bias of spring 116. When housing 26 reaches its closed position, cam 128 should hold latch plate 104 in its unlatch position allowing switch 78 and knob 80 to be rotated from their off position to their on position. When switch 78 and knob 80 rotate to their on position, arcuate arm 94 extends into aperture 126 of catch 120. With arcuate arm 94 extending through aperture 126, housing 26 is held in its closed position and is prevented from being opened.

A suitable latch mechanism can also be provided between switch box 11 and housing 26 for allowing locking therebetween to prevent undesired opening of housing 26 even when switch 78 and knob 80 are in their off position.

Now that the basic construction of device 76 according to the preferred teachings of the present invention has been explained, the operation and advantages of device 76 can be set forth and appreciated. For the sake of explanation, it will be assumed that housing 26 is in its closed position and switch 78 and knob 80 are in their on position in a manner as shown in FIG. 3. In particular, mechanism 10 can operate in its normal manner for control of the power tool or device. It should then be noted that arcuate arm 94 extends into aperture 126 of catch 120 to prevent moving housing 26 from its closed position and thus prevents access to the electric controls and the interior of switch box 11 while switch 78 and knob 80 are in their on position.

If access to the interior of switch box 11 is desired, it is first necessary to turn switch 78 and knob 80 to their off position. In the off position, arcuate arm 94 does not extend into aperture 126 of catch 120. Thus, housing 26 can be moved from its closed position. As soon as housing 26 moves from its closed position, cam 128 mounted to housing 26 moves allowing latch plate 104 to move from its unlatch position to its latch position in a manner as shown in FIGS. 1 and 2. In the latch position, plate 104 is positioned such that extension 96 extends into notch 110 to thereby prevent rotation of switch 78 and knob 80 from their off position towards their on position. It can then be appreciated that with switch 78 in its off position (and held therein by latch plate 104), power to the electrical controls located inside of switch box 11 is interrupted to prevent accidental shock from contact therewith. It should then be noted that locks can be provided through apertures 84 to prevent undesired rotation of switch 78 and knob 80 by others such as while service is being performed on the power tool or other device being controlled by mechanism 10.

In the event that power is desired to be provided to the electrical controls while housing 26 is not in its closed position, latch plate 104 can be manually overridden by pushing latch plate 104 from its latch position to its unlatch position. While latch plate 104 is being held in its unlatch position against the bias of spring 116, switch 78 and knob 80 can be rotated from their off position to their on position as set forth hereinbefore.

When access to the interior of switch box 11 is no longer desired and with switch 78 and knob 80 in their off position (and latch plate 104 being in its latch position due to the bias of spring 116), housing 26 can be moved to its closed position. As housing 26 moves to its closed position, cam 128 engages latch plate 104 and moves it from its latch position to its unlatch position. With housing 26 in its closed position and latch plate 104 in its unlatch position, switch 78 and knob 80 can be rotated from their off position to their on position, with arcuate arm 94 extending through aperture 126 of catch 120 to prevent moving housing 26 from its closed position in a manner as shown in FIG. 3.

It should then be appreciated that operation of device 76 according to the teachings of the present invention occurs from the side of box 11 and specifically there is no need for shaft 86 or knob 80 to extend through front wall 62 of cover 60 of housing 26. Thus, the entire front wall 62 is available for an operator to push to de-energize the electric circuit according to the teachings of the present invention. Thus, it can be appreciated that device 76 is especially advantageous in such applications where an interlock is desired but it is not desired to mount the movable components to the closure of the enclosure such as for electrical control boxes.

Further, it should be appreciated that the structural components of device 76 according to the preferred teachings of the present invention are either readily available, off-the-shelf components or can be inexpensively formed from bending and/or cutting flat sheet material. Device 76 is of a relatively simple, fool-proof design which is easy to manufacture and assemble according to the preferred teachings of the present invention.

Now that the basic teachings of the present invention have been explained, many extensions and variations will be obvious to one having ordinary skill in the art. For example, although various structural components have been shown and described to perform the functional requirements of the present invention and are believed to produce synergistic results, it should be appreciated that such functional requirements can be performed by other structural components in other arrangements according to the teachings of the present invention. As an example, although provisions 102 have been shown and described in the most preferred form as including a latch plate 104 which is pivotally mounted by mount 112, provisions 102 could be in the form of a latch plate which is pivotable as well as slideable relative to a mount.

Thus since the invention disclosed herein may be embodied in other specific forms without departing from the spirit or general characteristics thereof, some of which forms have been indicated, the embodiments described herein are to be considered in all respects illustrative and not restrictive. The scope of the invention is to be indicated by the appended claims, rather than by the foregoing description, and all changes which come within the meaning and range of equivalency of the claims are intended to be embraced therein.

I claim:

1. Interlock device for an enclosure having an opening and a closure having a closed position extending over the opening and an open position allowing access through the opening, comprising, in combination: a latch rotatable about an axis between a first position and a second position; means for selectively preventing rotation of the latch and having a latch position and an unlatch position, with the selectively preventing means in the unlatch position allowing rotation of the latch and the selectively preventing means in the latch position preventing rotation of the latch from its second position to its first position; means mountable to the closure for catching the latch in the first position when the closure is in the closed position to prevent the closure from moving from the closed position; and means for moving the selectively preventing means from the latch position to the unlatch position when the closure is in the closed position.

2. The interlock device of claim 1 wherein the selectively preventing means allows manual movement from the latch position to the unlatch position when the closure is in the open position.

3. The interlock device of claim 2 wherein the selectively preventing means comprises, in combination: a latch plate movable between the latch and unlatch positions; means for biasing the latch plate from the unlatch position to the latch position; a notch formed in the latch plate; and an extension rotatable with the latch about the axis, with the extension being received in the notch when the latch plate is in the latch position and the latch is in the second position.

4. The interlock device of claim 3 wherein the extension includes a cam surface for abutting with the latch plate in the latch position with the cam surface moving the latch plate from the latch position to the unlatch position as the latch moves from the first position towards the second position and allowing the latch plate to move to the latch position under the bias of the biasing means when the latch reaches the second position.

5. The interlock device of claim 3 wherein the latch plate is pivotally mounted to a mount for movement between the latch and unlatch positions; and wherein the biasing means comprises a spring sandwiched between the latch plate and the mount.

6. The interlock device of claim 3 wherein the moving means comprises a cam for moving the latch plate from the latch position to the unlatch position as the closure moves from the open position to the closed position, with the cam holding the latch plate in the unlatch position when the closure is in the closed position.

7. The interlock device of claim 6 wherein the extension is integrally formed with the latch and the catching means is integrally formed with the moving means.

8. The interlock device of claim 6 wherein the latch includes an arcuate arm spaced from and concentric to the axis; and wherein the catching means includes an aperture, with the arcuate arm extending through the aperture in the first position and the arcuate arm being spaced from the aperture in the second position.

9. The interlock device of claim 8 further comprising, in combination: a switch rotatable with the latch between the first and second positions, with the switch being on in the first position and being off in the second position.

10. The interlock device of claim 9 further comprising, in combination: a knob rotatable with the latch between the first and second positions; and a collar, with the knob rotatably received within the collar, with the knob and collar including lock-out apertures which are aligned when the knob is in the second position.

11. Interlock device for an enclosure having an opening and a closure having a closed position extending over the opening and an open position allowing access through the opening, comprising, in combination: a latch rotatable about an axis between a first position and a second position; means for selectively preventing rotation of the latch and having a latch position and an unlatch position, with the selectively preventing means in the unlatch position allowing rotation of the latch and the selectively preventing means in the latch position preventing rotation of the latch from its second position to its first position; means for biasing the selectively preventing means from the unlatch position to the latch position; and a cam surface for abutting with the selectively preventing means in the latch position with the cam surface moving the selectively preventing means from the latch position to the unlatch position as the latch moves from the first position towards the second position and allowing the selectively preventing means to move to the latch position under the bias of the biasing means when the latch reaches the second position.

12. The interlock device of claim 11 further comprising, in combination: means for moving the selectively preventing means from the latch position to the unlatch position when the closure is in the closed position.

13. The interlock device of claim 12 further comprising, in combination: means for catching the latch in the first position when the closure is in the closed position.

14. The interlock device of claim 13 wherein the catching means is mountable to the closure and prevents the closure from moving from the closed position when the latch is caught in the first position.

15. The interlock device of claim 13 wherein the moving means comprises a cam for moving the selectively preventing means from the latch position to the unlatch position as the closure moves from the open position to the closed position, with the cam holding the selectively preventing means in the unlatch position when the closure is in the closed position.

16. The interlock device of claim 15 wherein the catching means is integrally formed with the moving means.

17. The interlock device of claim 15 wherein the latch includes an arcuate arm spaced from and concentric to the axis; and wherein the catching means includes an aperture, with the arcuate arm extending through the aperture in the first position and the arcuate arm being spaced from the aperture in the second position.

18. The interlock device of claim 17 further comprising, in combination: a switch rotatable with the latch between the first and second positions, with the switch being on in the first position and being off in the second position.

19. The interlock device of claim 18 further comprising, in combination: a knob rotatable with the latch between the first and second positions; and a collar, with the knob rotatably received within the collar, with the knob and collar including lock-out apertures which are aligned when the knob is in the second position.

20. The interlock device of claim 1 wherein the moving means comprises a cam for moving the selectively preventing means from the latch position to the unlatch position as the closure moves from the open position to the closed position, with the cam holding the selectively preventing means in the unlatch position when the closure is in the closed position.

21. The interlock device of claim 1 wherein the catching means is integrally formed with the moving means.

22. Interlock device for an enclosure having an opening and a closure having a closed position extending over the opening and an open position allowing access through the opening, comprising, in combination: a latch rotatable about an axis between a first position and a second position; means for selectively preventing rotation of the latch and having a latch position and an unlatch position, with the selectively preventing means in the unlatch position allowing rotation of the latch and the selectively preventing means in the latch position preventing rotation of the latch from its second position to its first position; means for catching the latch in the first position when the closure is in the closed position; and means for moving the selectively preventing means from the latch position to the unlatch position when the closure is in the closed position; wherein the latch includes an arcuate arm spaced from and concentric to the axis; and wherein the catching means includes an aperture, with the arcuate arm extending through the aperture in the first position and the arcuate arm being spaced from the aperture in the second position.

23. The interlock device of claim 1 further comprising, in combination: a switch rotatable with the latch between the first and second positions, with the switch being on in the first position and being off in the second position.

* * * * *